United States Patent [19]

Derr, Jr. et al.

[11] Patent Number: 4,990,239

[45] Date of Patent: Feb. 5, 1991

[54] PRODUCTION OF GASOLINE AND DISTILLATE FUELS FROM LIGHT CYCLE OIL

[75] Inventors: W. Rodman Derr, Jr., Vincentown; Peter J. Owens, Mantua; Michael S. Sarli, Haddonfield, all of N.J.

[73] Assignee: Mobil Oil Corporation, Fairfax, Va.

[21] Appl. No.: 449,168

[22] Filed: Dec. 13, 1989

Related U.S. Application Data

[63] Continuation-in-part of Ser. No. 433,251, Nov. 8, 1989.

[51] Int. Cl.[5] ..... C10G 65/12

[52] U.S. Cl. ..... 208/68; 208/67; 208/74; 208/69; 208/89; 208/111

[58] Field of Search ..... 208/68, 69, 74, 111, 208/89

[56] References Cited

U.S. PATENT DOCUMENTS

| | | | |
|---|---|---|---|
| 4,207,167 | 12/1980 | Bradshaw | 208/68 |
| 4,585,545 | 4/1986 | Yancy et al. | 208/68 |
| 4,676,887 | 6/1987 | Fischer et al. | 208/68 |
| 4,738,766 | 4/1988 | Fischer et al. | 208/68 |
| 4,789,457 | 12/1988 | Fischer et al. | 208/68 |
| 4,828,675 | 5/1984 | Sawyer et al. | 208/57 |
| 4,828,676 | 5/1984 | Sawyer et al. | 208/57 |

*Primary Examiner*—Helane E. Myers

*Attorney, Agent, or Firm*—Alexander J. McKillop; Charles J. Speciale; Malcolm D. Keen

[57] ABSTRACT

High octane gasoline and high quality distillate are co-produced by a hydrocracking light cycle oil from a catalytic cracking process under conditions of low to moderate hydrogen pressure and severity to produce a high octane, hydrocracked gasoline. The distillate fraction from the hydrocracker is separated to form a first fraction which boils immediately above the gasoline fraction and a second, higher boiling fraction which is withdrawn as product. The first distillate fraction is recycled, preferably to extinction, to the cracker to increase the paraffinic content of the higher boiling distillate product by removal of the hydroaromatic components in the recycled fraction. The recycled fraction may be mixed with fresh feed to the cracker or may be injected at a higher level in the cracking riser as a secondary feed injection. The paraffinic distillate product has a low sulfur content and a high cetane index and is useful as a road diesel fuel.

18 Claims, 1 Drawing Sheet

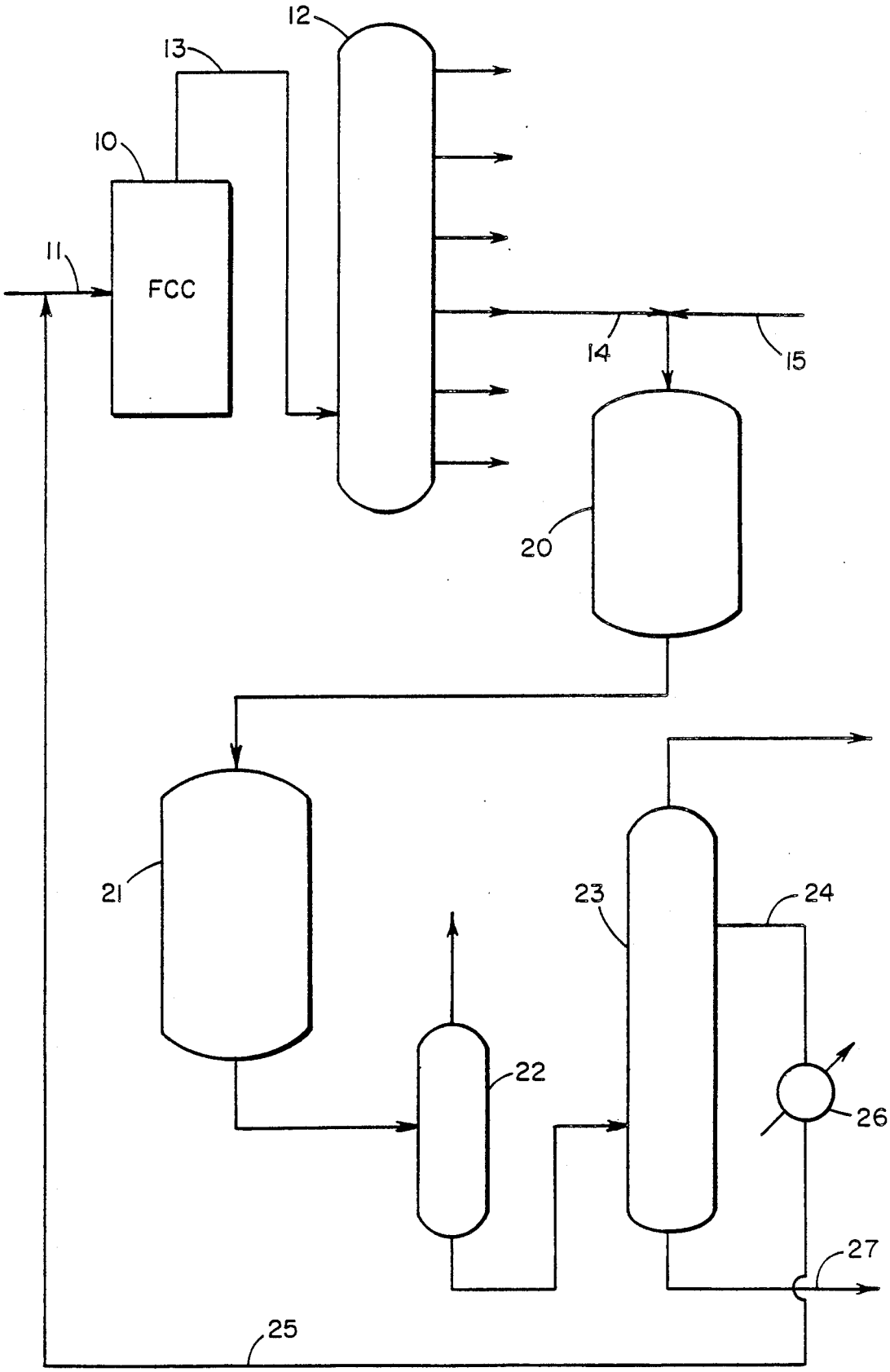
12
13
10
11
FCC
14
15
20
21
23
24
22
26
27
25

PRODUCTION OF GASOLINE AND DISTILLATE FUELS FROM LIGHT CYCLE OIL

CROSS REFERENCE TO RELATED APPLICATIONS

This application is a continuation-in-part of our prior application Ser. No. 07/433,251, filed 8 Nov. 1989 pending, entitled Production of gasoline and Distillate Fuels from Light Cycle Oil.

FIELD OF THE INVENTION

This invention relates to a process for producing high quality gasoline and distillate fuel products from cycle oils obtained by catalytic cracking processes.

BACKGROUND OF THE INVENTION

U.S. Pat. No. 4,676,887 discloses a significant advance in the refining of petroleum hydrocarbons to product motor fuels and other products. The process described in U.S. Pat. No. 4,676,887 operates by hydrocracking a highly aromatic feed which is produced by catalytic cracking of a suitable petroleum fraction, usually a vacuum gas oil. During the catalytic cracking the dealkylation processes characteristic of the catalytic cracking process remove alkyl groups from the polyaromatic materials in the feed to produce the gasoline as the main product together with various other higher boiling fractions. A highly aromatic distillate fraction formed in the cracking and boiling from about 400° F. to 750° F. (about 205° to 400° C.), generally referred to as cycle oil, forms a preferred feed for the subsequent hydrocracking step which converts the bicyclic aromatics (naphthalenes) in the oil under relatively mild conditions to monocyclic aromatics in the gasoline boiling range. In this way, the cycle oil from the cracking process is converted to a gasoline range product, which, being highly aromatic, has a high octane value and can therefore be incorporated directly into the refinery gasoline pool without the need for subsequent reforming. A notable advantage of the process is the use of relatively mild conditions e.g., hydrogen pressure under 1000 psig, (about 7000 kPa abs) and moderate conversion coupled with an acceptably low catalyst aging rate so that long cycle durations may be obtained. Reference is made to U.S. Pat. No. 4,676,887 for a detailed description of the process.

As mentioned above, a cycle oil from the catalytic cracking step is used as the feed to the hydrocracking step and usually, a light cycle oil boiling approximately in the range of 400° to 700° F. (about 205° to 400° C.) is suitable. However, if a light cut-light cycle oil with an end point of not more than about 650° F. (345° C.), preferably not more than about 600° C. (about 315° C.) is used it is possible to operate at rather higher conversion levels without a concomitant increase in hydrogen pressure while still maintaining an acceptable aging rate in the catalyst. In addition, the octane rating of the hydrocracked gasoline is higher. Thus, by suitable choice of the hydrocracker feed, an extended range of operating conditions may be utilized while improving product quality. The use of the light cut light, cycle oil in this process is disclosed in U.S. Pat. No. 4,738,766, to which reference is made for a detailed disclosure of the process.

Because the hydrocracking is operated under relatively low hydrogen pressure, conversion is maintained at a relatively moderate level in order to maintain catalyst aging at an acceptable rate. One consequence of this is that the effluent from the hydrocracker contains significant quantities of unconverted material i.e. products boiling above the gasoline boiling range. The hydrocracking step has effected a removal of a significant amount of the heteroatom containing impurities in the cycle oil feed and this is reflected by relatively low sulfur and nitrogen contents in the gasoline conversion product as well as in the higher boiling fractions. In addition, some of the higher boiling fractions have undergone hydrogenation to form more readily crackable components, and for this reason a useful aspect of the process is in the recycle of the unconverted hydrocracker bottoms to the catalytic cracking unit. A process of this type is disclosed in U.S. Pat. No. 4,789,457 to which reference is made for a detailed description of the process.

In application Ser. No. 07/433,251, filed 8 Nov. 1989 we have disclosed a process for the co-production of high octane gasoline simultaneously with a high quality fuel oil useful as a blending stock for road diesel fuel. In the process disclosed in Ser. No. 07/433,251 the cycle oil from the catalytic cracking unit is hydrocracked under moderate pressure conditions to produce the high octane gasoline which is separated in the unit fractionator. Also separated in the fractionator is a heart cut distillate fraction, typically a 420°-480° F.(215°-250° C.)fraction, which is recycled to the hydrocracker. As noted in Ser. No. 07/433,251, the distillate fraction which boils just above the gasoline boiling range has a lower octane number than the hydrocracked gasoline product as well as a cetane number hich disqualifies it from use as a road diesel fuel. Although, with these properties, it might seem to be a rather unpromising material, a closer study of its composition showed that it possessed considerable potential for further processing. This fraction is rich in hydroaromatics which are the precursors of the hydrocracked, aromatic gasoline and therefore could be subjected to further ring opening reactions to increase the yield of gasoline as well as the cetane rating of the distillate by removal of the hydroaromatic components. In the process described in Ser. No. 07/433,251, the portion of the hydrocracked product which contains these hydroaromatic components is recycled to the hydrocracker for conversion to gasoline in a second pass through the hydrocracker. Reference is made to Ser. No. 07/433,251 for a detailed description of the process and its operation.

SUMMARY OF THE INVENTION

It has now been found that it is possible to produce a high quality middle distillate fuel in addition to the high octane gasoline by a modification of the process described in Ser. No. 07/433,251. According to the present invention, the portion of the distillate fraction which boils immediately above the gasoline boiling range is recycled to the catalytic cracking unit. In this way, the low-cetane hydroaromatic components are removed from the distillate product while simultaneously providing a low-sulfur feed fraction for the cracker. In practice, recycle of the 420° to 480° F. (about 215° to 250° C.) fraction of the hydrocracked products represents the optimum mode of operation to produce a low sulfur, high cetane index diesel fuel.

According to the present invention, therefore, the process for producing high quality gasoline and distillate products from a dealkylated feedstock produced by catalytic cracking of a petroleum fraction comprises hydrocracking the dealkylated feedstock to produce a high octane, hydrocracked gasoline fraction and a distillate fraction boiling above the gasoline boiling range. The distillate fraction is subjected to fractionation to separate the lowest boiling fraction of the distillate fraction and some or all of this fraction is recycled to cracking operation. In general, the 420° to 480° F.(215° to 250° C.) fraction is selected for recycle to the cracker zone although these cut points may be varied somewhat without significant changes in product quality.

The hydrocracking is preferaby operated under relatively moderate conditions, typically with hydrogen partial pressures less than 1200 psia (about 8275 kPa) and preferably less than 1000 psia (about 7000 kPa). Conversion is also maintained at relatively moderate levels, typically below about 65 wt percent to gasoline boiling range or lighter products.

THE DRAWINGS

The single figure of the accompanying drawings is a simplified process flow sheet for the coproduction of high octane gasoline and diesel fuel by hydrocracking.

DETAILED DESCRIPTION

Process Considerations

The considerations affecting the process and the selection of conditions are set out in Ser. No. 07/433,251 but are repeated below for convenience.

The light cycle oil hydrocracking process disclosed in U.S. Pat. No. 4,676,887, U.S. Pat. No. 4,738,766 and U.S. Pat. No. 4,789,457 relies upon the selective, partial hydrogenation of bicyclic aromatics in catalytic cracking light cycle oil (LCO) coupled with selective conversion to high octane aromatic gasoline. The octane number of the hydrocracked gasoline is typically at least 90 (R+0), and it can therefore be blended directly into the unleaded refinery gasoline pool without need for reforming. The unconverted distillate fraction is more paraffinic than the feed as a result of the partial saturation and cracking of the bicyclic aromatics present in the original cycle oil feed to the hydrocracker. In addition, a considerable degree of desulfurization and denitrogenation has occurred as a consequence of the hydrogenation and ring opening reactions which take place over the hydrocracking catalyst. The quality of the unconverted distillate fraction is therefore significantly higher than that of the cycle oil feed and the degree of improvement increases as hydrocracking conversion is increased. The cetane rating of the unconverted fraction is notably higher than that of the parent cycle oil as a consequence of the higher paraffinic content and reduced aromaticity. This is demonstrated by the comparison given in Table 1 below which reports typical feed and product properties for the cycle oil hydrocracking process employing a light cycle oil (LCO) feed with a boiling range of 400° to 620° F. (205° to 325° C.) at 510 psia (3516 kPa) hydrogen partial pressure.

TABLE 1

Typical LCO-Upgrading Feed and Product Properties

| 420° F.+ (215° C.+) Conversion, % Wt | Feed | Product 45 | Product 55 |
|---|---|---|---|
| $C_5$-420° F. ($C_5$-215° C.) | | | |
| API Gravity | | 35.7 | 36.8 |
| Hydrogen, wt % | | 11.04 | 11.27 |
| Sulfur, wt % | | .01 | .01 |

TABLE 1-continued

Typical LCO-Upgrading Feed and Product Properties

| 420° F.+ (215° C.+) Conversion, % Wt | Feed | Product 45 | Product 55 |
|---|---|---|---|
| Octane, | | | |
| R + O | | 100 | 100 |
| M + O | | 88 | 88 |
| Paraffins, wt % | | 9 | 10 |
| Olefins, wt % | | 1 | 1 |
| Naphthenes, wt % | | 8 | 9 |
| Aromatics, wt % | | 82 | 80 |
| 420° F.+ (215° C.+) | | | |
| API Gravity | 15.9 | 26.5 | 28.5 |
| Hydrogen, wt % | 9.46 | 11.07 | 11.39 |
| Nitrogen, ppm | 210 | 4 | 5 |
| Sulfur, wt % | 2.6 | <.05 | <.05 |
| Cetane Index | 24 | 35 | 38 |
| Paraffins, wt % | 10 | 21 | 25 |
| Olefins, wt % | 4 | — | — |
| Naphthenes, wt % | 4 | 10 | 13 |
| Aromatics, wt % | 82 | 69 | 62 |

The improvement in the ignition qualities of the middle distillate product at increasing hydrocracking conversion indicate that further improvement could be expected by increasing the hydrocracking conversion still further, i.e., above 55 wt. % 420° F. plus (215° C.+). The nitrogen content and the type of aromatics present in the cycle oil feed may, however, institute a limit on the conversion which may be attained during the hydrocracking if acceptable rates of catalyst aging are to be maintained. Other limitations on conversion may also appear. At the maximum acceptable conversion levels, the concentration of bicyclic aromatics in the fraction boiling above the gasoline boiling range, has been significantly reduced by the characteristic partial hydrogenation and cracking reactions, with a concommitant increase in paraffin concentration. Any further increase in hydrocracking conversion increases paraffin concentration to the point where paraffin cracking becomes significant and the octane rating of the gasoline product declines as a result of the inclusion of relatively low octane paraffins in the otherwise highly aromatic gasoline. Thus, conversion may have to be limited both to secure satisfactory catalyst aging as well as to maintain good product octane. In practice, a conversion level of approximately 65 wt. % (420° F.+ (215° C.+) conversion) may represent the acceptable maximum if the quality of the gasoline is to be maintained at its desired high level.

Further analysis of the unconverted 420° F.+ (215° C.+) fraction indicates that the lowest boiling portion of the fraction is a material with considerable potential for further utilization. This is demonstrated by consideration of Table 2 below which gives the typical properties of the 420° F.+ (215° C.+) product from the hydrocracker at a nominal 55 wt. pct. 420° F.+ (215° C.+) conversion.

TABLE 2

Typical Properties of 420° F.+ (215° F.+) Product at 55 wt. % 420° F.+ (215° C.+) Conversion

| | 420° F.+° | 420–480° F. | 480° F.+ |
|---|---|---|---|
| Yield on FF, % wt | 40.4 | 16.2 | 24.2 |
| API Gravity | 25.4 | 26.4 | 24.8 |
| Sulfur, % wt | .01 | .002 | .02 |
| Nitrogen, ppmw | 8 | 2 | 12 |
| Octane, R + O | — | 97.5 | — |
| Cetane Index | 34 | 25 | 36 |
| Paraffins, % wt | 22 | 17 | 25 |
| Naphthenes, % wt | 10 | 6 | 12 |

TABLE 2-continued

| Typical Properties of 420° F.+ (215° F.+) Product at 55 wt. % 420° F.+ (215° C.+) Conversion | | | |
|---|---|---|---|
| | 420° F.+* | 420–480° F. | 480° F.+ |
| Aromatics, % wt | | | |
| Alkyl-benzenes | | 20 | |
| Tetralins | | 40 | |
| Total | 68 | 77 | 63 |

*Calculated, by combination

It has been found that the composition and quantity of the 420° F.+ (215° C.+) fraction remain relatively constant over a wide range of conversion levels, a consequence of which is that with increasing conversion of the heavier aromatic components of the cycle oil feed to the hydrocracker, a compositional gradient develops relative to boiling range.

The 420° to 480° F. (215° to 250° C.) boiling range material is somewhat lower in aromatic content and slightly lower in octane, typically 2 to 4 R+0, than the hydrocracked gasoline product. If this portion of the unconverted material is divided between the gasoline and middle distillate products, the quality of both streams is degraded. The octane value of the 420° to 480° F. (215° to 250° C.) cut is typically 2 to 4 R+0 lower than that of the 420° F.− (215° C.−)gasoline; in addition, end point restrictions also limit the amount of this high boiling fraction which can be included in the gasoline pool. With its relatively high aromatic content, however, it has a very low cetane blending value and should be excluded from the distillate pool so that even though its sulfur content is acceptably low, it is unacceptable for use as road diesel fuel. With recent and expected regulations requiring significantly reduced sulfur and aromatic contents in road diesel fuels this means that there is a potential for further product upgrading, especially in terms of aromatic content.

The lowest boiling fraction of the unconverted hydrocracked product is most suited for additional conversion because it contains a high content of bicyclic hydroaromatics (tetralins) which are the primarily intermediate in conversion of light cycle oil aromatics to high octane gasoline. The relatively low molecular weight of the aromatics in this boiling range ($C_{10}$ to $C_{12}$) is, however, a limiting factor: higher boiling range aromatics appear to be more strongly adsorbed onto the hydrocracking catalyst and therefore react in preference to the lighter aromatics. As conversion increases, there appears to be competition between the lighter aromatics and the heavier paraffins and in single pass operation the levels of conversion necessary to achieve significant conversion of the lowest boiling aromatic fraction of the unconverted material from the first pass can also result in significant conversion of paraffins with consequent reduction in the octane rating of the gasoline product, as noted above.

Removal of the lowest boiling fraction of the unconverted material, preferably the 420° to 480° F. (215° to 250° C.) fraction will result in an improvement in the ignition quality of the unconverted distillate, i.e., distillate not converted to gasoline, by further reduction of the aromatics content of the unconverted material. Recycle of the removed material to the hydrocracker as described in Ser. No. 07/433,251, results in an increase in production of hydrocracked gasoline but if single pass operation of the hydrocracker is desired, for example, to maintain hydrocracking capacity, this fraction may be recycled to the catalytic cracking unit for which it forms a high quality, low sulfur feed which is not only readily crackable but is also capable of favorably affecting cracker operation.

Process Configuration

The figure illustrates a simplified schematic flow sheet for producing high quality hydrocracked gasoline together with a high quality distillate fuel oil suitable for use as road diesel fuel.

The fresh feed for the catalytic cracking unit 10, here a fluid Catalytic Cracker(FCC), enters through line 11 and undergoes cracking in the unit with the cracked products passing to the fractionator section 12 of the unit through line 13. In the fractionator, the various product fractions are separated in the conventional manner with fractions leaving the column through the product withdrawal lines approximately as shown. The cycle oil fraction, preferably a light cut cycle oil (LCO) with a maximum end point of about 620° F. (about 325° C.), is withdrawn from the column and passes to the hydrocracker by way of line 14. The cycle oil enters through line 14 and is mixed with hydrogen entering through line 15. The hydrogen and LCO feed enter hydrotreater 20 and undergo hydrotreating to remove sulfur, nitrogen and other heteroatom-containing impurities as well as to effect a preliminary degree of aromatic saturation, depending upon the nature of the catalyst and the conditions employed. The hydrotreated cycle oil then passes to hydrocracker 21 where the characteristic hydrocracking reactions occur under conditions of moderate hydrogen pressure and severity to produce the desired high octane gasoline product together with a higher boiling unconverted fraction as described above. The effluent from the hydrocracker passes to separator 22 to remove hydrogen and light hydrocarbons. The hydrogen is recycled after appropriate purification and reenters the hydrogen circuit of the unit together with any necessary make-up hydrogen through line 15. The separated effluent from drum 22 passes to fractionator 23 where it is fractionated into the gasoline product, typically 420° F.− (215° C.−) gasoline as well as a distillate product, typically a 420° F.+ (215° C.+) distillate. The lowest boiling fraction of the material boiling immediately above the gasoline boiling range, preferably a 420°–480° F. (215°–250° C.) fraction is removed as a side draw from the fractionator through line 24 and recycled to the cracker through recycle line 25 after cooling in heat exchanger 26. The portion of the unconverted material boiling above this recycled fraction, preferably 480° F.+ (250° C.+) distillate, is withdrawn from the fractionator through line 27 as bottoms and may then be passed to the fuel oil pool e.g., for use as heating oil or for blending into the distillate fuel oil pool. The cooled lighter distillate from heat exchanger 26 is mixed with the fresh feed to the cracker entering the unit through line 11.

The fraction which is recycled to the cracker may, instead of being mixed with the fresh feed to the cracker which is fed into the base of the cracking riser, be injected at a higher level into the riser as a secondary feed injection. When used in this way, the recycled fraction may act as a quench fluid to reduce the temperature at higher levels in the riser. Catalytic cracking processes using secondary injection into a higher level of the riser are described in U.S. Pat. No. 3,896,024 (Nace), U.S. Pat. No. 4,218,306 (Gross), U.S. Pat. No. 4,444,722 (Owen), U.S. Pat. No. 4,422,925 (Williams), U.S. Pat.

No. 3,617,497 (Bryson), U.S. Pat. No. 4,832,825 (Mauleon) and European Patent Publ. No. 232,587 (Krishna/Chevron), to which reference is made for a description of such processes. The recycled fraction may be injected into the cracking riser in the manner described in these processes and may act as a quench fluid to reduce the instantaneous cracking temperature at the point of injection, which is a desirable feature when oprating with resid feeds.

The proportion of the lowest boiling distillate material recycled to the cracker may be varied internally within the fractionator by use of a side draw tray with a weir over which material in excess of the amount withdrawn for recycle will spill into the bottom of the fractionator where it combines with the 480° F.+ (250° C.+) fraction and is withdrawn as bottoms. Alternatively, the entire fraction may be withdrawn and a controlled amount taken off externally and recycled to the cracker, with the balance being combined with the higher boiling bottoms fraction. It is considered desirable to recycle the entire fraction to the cracker so as to convert the paraffins in ths fraction to $C_3$–$C_5$ olefins which may be used as feed for alkylation, etherification or olefin hydration units, as well as contibuting to an increase in the overall gasoline yield.

Hydrocracker Feed

The feed to the hydrocracker is a light cycle oil produced by catalytic cracking, usually by the fluid catalytic cracking (FCC) process. The catalytic cracker may be operated in conventional fashion to produce the desired products. Catalytic cracker operation is well established in the petroleum refining industry and requires no further elaboration. The cycle oil cracking product which is removed from the cracking fractionator and passed to the hydrocracker is a substantially dealkylated feedstock which will have a hydrogen content no greater than 12.5 wt. % and an API gravity no greater than about 25, preferably no greater than about 20 and an aromatic content no less than about 50 wt. %. Typically the feed will have an API gravity of 5 to 25, a nitrogen content of 50 to 650 ppm and will contain 8.5 to 12.5 wt. pct. hydrogen. The boiling range of the cycle oil will usually be from about 400° to 800° F. (205 to 425° C.), more commonly 400° to 700° F. (205° to 370° C.). Thus, the feeds may be as described in U.S. Pat. No. 4,676,887 to which reference is made for a further and more detailed disclosure of suitable feeds.

The preferred feeds for the hydrocracker are the light cut LCO feeds having an end point of not more than 650° F. (345° C.), preferably not more than 600° F. (about 325° C.)e.g. 620° F.(327° C.), as described in U.S. Pat. No. 4,738,766 to which reference is made for a further and more detailed disclosure of preferred feeds of this type.

Hydrocracker Feed Hydrotreating

Conventional hydrotreating catalysts and conditions may be employed. The hydrotreating catalyst will typically comprise a base metal hydrogenation function on a relatively inert, i.e., non-acidic porous support material such as alumina, silica or silica alumina. Suitable metal functions include the metals of Groups VI and VIII of the Periodic Table, preferably cobalt, nickel, molybdenum, vanadium and tungsten. Combinations of these metals such as cobalt-molybdenum and nickel-molybdenum will usually be preferred. Since the hydrotreated effluent is preferably cascaded directly into the hydrocracker without interstage separation, hydrogen pressure will be dictated by the requirements of the hydrocracking step, as described below. Temperature conditions may be varied according to feed characteristics and catalyst activity in a conventional manner.

Reference is made to U.S. Pat. No. 4,738,766 for a more detailed description of suitable hydrotreating catalysts and conditions which may also be suitably employed in the present process.

Hydrocracking Catalysts

The preferred hydrocracking catalysts for use in the present process are the zeolite hydrocracking catalysts, comprising a large pore size zeolite, usually composited with a binder such as silica, alumina or silica alumina. The aromatic-selective large pore size zeolites such as zeolites X and Y are preferred in order to effect the desired conversion of the highly aromatic feeds to produce the aromatic, high octane gasoline product. The paraffin selective zeolite beta is usually not preferred for this reason. An especially preferred hydrocracking catalyst is based on the ultra-stable zeolite Y (USY) with base metal hydrogenation components selected from Groups VIA and VIIIA of the Periodic Table (IUPAC Table). Combinations of Groups VIA and VIIIA metals are especially favorable for hydrocracking, for example nickel-tungsten, nickel-molybdenum etc.

A more extensive and detailed description of suitable catalysts for the present process may be found in U.S. Pat. Nos. 4,676,887, 4,738,766 and 4,789,457 to which reference is made for a disclosure of useful hydrocracking catalysts.

Hydrocracking Conditions F The hydrocracking conditions employed in the present process are generally those of low to moderate hydrogen pressure and low to moderate hydrocracking severity. Hydrogen pressure (reactor inlet) is maintained below about 1200 psia (about 8275 kPa), preferably below about 1000 psia (about 7000 kPa). Generally, the minimum hydrogen pressure will be about 400 psia (about 2760 kPa) in order to effect the desired degree of saturation of the bicyclic aromatics present in the cycle oil feeds. Pressures of 700 to 900 psig (about 4825 to 6205 kPa) are especially useful. Hydrogen circulation rates of up to about 10,000 SCF/Bbl (about 1,780 $n.l.l^{-1}$), more usually up to about 6,000 SCF/Bbl (about 1070 $n.l.l^{-1}$) are suitable, with additional hydrogen suppied as quench to the hydrocracking zone, usually in comparable amounts. Hydrogen consumption is usually about 1200 to 3000 SCF/Bbl (about 210 to 535 $n.l.l^{-1}$), and in most cases aboout 1500–2500 SCF/Bbl (about 270 to 445 $n.l.l^{-1}$), depending on the heteroatom content and the level of conversion, with hydrogen consumption increasing with both with heteroatom content and conversion.

Temperatures are maintained usually in the range of about 650° to about 850° F. (about 315° to about 455° C.) and more usually will be in the range of about 675° to 800° F. (360° to 425° C.). A preferred operating range is about 700° to 775° F.( about 370° to about 410° C.). The operating temperature of the hydrocracker may be progressively raised over the course of a cycle in order to compensate for decreasing cracking activity of the catalyst with aging. Thus, the selected temperature will depend upon the character of the feed, hydrogen pressure employed and the desired conversion level.

Conversion is maintained at relatively moderate levels and, as noted above, will usually not exceed about 65 wt. percent to gasoline boiling range materials e.g. 420° F.+ (215° C.+) conversion, for the most highly aromatic feeds. However, higher conversion levels may be attained without unacceptable losses in gasoline octane with lighter cut feeds such as the Light Cut LCO feeds whose use in this type of process is disclosed in U.S. Pat. No. 4,738,766 to which reference is made for a description of the hydrocracking process conditions applicable with such lighter cycle oil feeds.

With normal light cut light cycle oil feeds having end points from about 600° to 650° F. (about 315° to 345° C.), preferably not substantially above 620° F. (about 325° C.), it is preferred to maintain the conversion in the range of about 45–65 wt percent (420° F.+, 215° C.+conversion) at hydrogen partial pressures of 800–850 psia (5515 to 5860 kPa). In one form of the process, the conversion may be maintained below about 50 wt. percent (to gasoline boiling range products), preferably at a maximum value which does not exceed 0.05 times the hydrogen pressure (expressed in psig, reactor inlet) as disclosed in U.S. Pat. No. 4,676,887 to which reference is made for a detailed description of suitable hydrocracking conditions which may be employed with light cycle oil feeds of this type. Other reaction conditions will be varied in order to achieve the desired conversions and to this end, space velocities will be generally in the range of 0.5 to 2, preferably about 0.75–1.0, $hr^{-1}$ (LHSV). A full disclosure of suitable reaction conditions is to be found in the LCO operating process patents referred to above.

Hydrocracked Product Fractionation

The effluent from the hydrocracker is subjected to fractionation after removal of hydrogen and light ends to yield the desired highly aromatic, high octane gasoline product as disclosed in U.S. Pat. No. 4,676,887. The higher boiling distillate fraction which remains is then fractionated further so that at least some of the lowest boiling portion of this distillate i.e. the fraction boiling immediately above the gasoline, is separated for return as recycle to the cracker. The initial boiling point of this fraction will therefore be determined by the end point of the gasoline fraction which may typically vary from about 330° F. (about 165° C.) to about 440° F. (about 225° C.) although intermediate gasoline end points e.g. 365° C. (185° C.), 385° F. (195° C.) may be employed as desired according to market specifications and the effect of regulatory requirements. For example, gasoline end point (ASTM D-439) is limited to 437° F. (225° C.) by ASTM D-86 with a maximum 2 vol. % residue. Thus, the lowest boiling fraction of the distillate will typically have an initial boiling point in the range of about 330° to about 440° F. (about 165° to about 225° C.). The end point of this lowest boiling portion of the distillate will normally be about 480° F. since with higher end points greater proportions of the paraffin components of the unconverted fraction will be returned as recycle to the cracker with the undesirable consequences enumerated above. Thus, the end point of the recycle fraction will typically be in the range of about 450° to 500° F. (about 230° to 260° C.) more usually about 460° to 490° F. (about 240° to 255° C.).

The amount of this fraction to be recycled to the cracker is typically from 1 to 100, preferably from 5 to 50, weight percent of the hydrocracked products which boil in the range selected for the recycle fraction. As noted above, the amount of this lowest boiling fraction of the unconverted distillate material which is produced in the hydrocracking step is relatively independent of hydrocracking conversion and accordingly, it will normally be available in the amount desired for recycle. The entire fraction may be recycled so that the distillate is essentially free of this relatively aromatic material but lower recycle ratios may be employed if the distillate is used as a blend component or utilised for fuels with less demanding specifications than road diesel.

Hydrocracking Products

As described above, the hydrocracking results in the production of a highly aromatic, high octane gasoline fraction, typically with an octane rating of at least 87 (R+0), usually at least 90 e.g. 95 (R+0). As noted in Table 1 above, it is possible to produce 100 octane (R+0) with an average (0.5(R+M)+0) of at least 93 by this process. Thus, the gasoline product is suitable for blending into the unleaded refinery gasoline pool without reforming or other treatment to improve its ignition qualities. In addition, the gasoline has a low level of sulfur and of olefins which is consistent with good environmental fuel qualities.

The hydrocracked middle distillate product is notable for low sulfur and nitrogen content and the higher boiling unconverted fractions, typically the 480° F.+ (about 250° C.+) e.g. 480° to 700° F. (250° to 370° C.) will have a higher cetane rating, typically at least 30, e.g. 35 or higher, than the lower boiling fraction which is recycled to the cracker so that an improved quality diesel fuel is produced.

In this specification the SI equivalents to FPS units are approximated to convenient values; SI pressures are absolute pressures.

We claim:

1. A process for the co-production of high quality gasoline and distillate products from catalytically cracked feedstocks which comprises:
   (i) catalytically cracking a hydrocarbon feedstock to produce a substantially dealkylated cracked product,
   (ii) hydrocracking the substantially dealkylated product with a hydrocracking catalyst at a hydrogen partial pressure not greater than 1200 psig and a conversion to gasoline boiling range products not more than 75 wt. percent;
   (iii) separating the products of hydrocracking into a gasoline boiling range fraction, a first distillate range fraction boiling immediately above the gasoline fraction with an end point in the range of 450° to 500° F. and a second, higher boiling distillate fraction which is more paraffinic than the first distillate fraction;
   (iv) recycling at least a portion of the first, lower boiling distillate fraction to the catalytic cracking step,
   (v) recovering the second, higher boiling distillate fraction .

2. A process according to claim 1 in which the substantially dealkylated product of the catalytic cracking step comprises a cycle oil having an end point of not more than 700° F.

3. A process according to claim 2 in which the cycle oil comprises a light cycle oil having an end point of not more than 650° F.

4. A process according to claim 3 in which the cycle oil is a light cycle oil having a boiling range in the range of 400° to 625° F.

5. A process according to claim 1 in which the substantially dealkylated feed has a hydrogen content of 8.5 to 12.5 wt. percent and an API gravity of 5 to 25.

6. A process according to claim 5 in which the feed has an aromatic content of 50 to 85 percent by weight.

7. A process according to claim 1 in which the hydrocracking is carried out at a hydrogen partial pressure (reactor inlet) not greater than 1000 psig.

8. A process according to claim 8 in which the hydrogen partial pressure (reactor inlet) is from 800 to 900 psig.

9. A process according to claim 1 in which the conversion to gasoline boiling range products is not more than 65 weight percent.

10. A process according to claim 8 in which the conversion to gasoline boiling range products is from 45 to 65 weight percent.

11. A process according to claim 1 in which the dealkylated product of the cracking step is subjected to hydrotreating prior to the hydrocracking to remove at least a portion of the organic sulfur and nitrogen compounds from the feed.

12. A process according to claim 1 in which the first distillate fraction boiling immediately above the gasoline boiling range has an initial boiling point of 330° to 440° F.

13. A process according to claim 12 in which the first distillate fraction boiling immediately above the gasoline boiling range has an end point of 470° to 490° F.

14. A process according to claim 1 in which the hydrocracking catalyst comprises an aromatic-selective, large pore size zeolite and a base metal hydrogenation function.

15. A process according to claim 15 in which the hydrocracking catalyst comprises zeolite USY and a base metal hydrogenation function.

16. A process for the co-production of high quality gasoline and low-sulfur distillate products from a catalytically cracked light cycle oil, which comprises:

(i) catalytically cracking a hydrocarbon cracking feedstock to produce a substantially dealkylated light cycle oil cracking product having a boiling range in the range of 400° to 650° F., a hydrogen content of 8.5 to 12.5 wt. pct. and an API gravity of 8 to 25, (ii) hydrotreating the light cycle oil cracking product, (iii) hydrocracking the hydrotreated light cycle oil at a hydrogen pressure of not more than 1200 psig (H2 partial pressure, reactor inlet), a temperature of 650° to 800° F., a conversion to gasoline boiling range products of not more than 75 wt. percent in the presence of a hydrocracking catalyst comprising a large pore size zeolite and a hydrogenation function, to form a hydrocracked product, (iv) separating a gasoline fraction from the hydrocracked product, (v) separating a first distillate fraction boiling immediately above the gasoline fraction with an end point in the range of 450° to 500° F. from the hydrocracked product, (vi) recycling at least a portion of the separated first distillate fraction to the catalytic cracking step, (vii) separating a second distillate fraction boiling above the first distillate fraction of higher paraffin content than the first distillate fraction from the hydrocracked products, (viii) recovering the second, relatively paraffinic distillate fraction.

17. A process according to claim 16 in which the first distillate fraction has an initial boiling point from 330° to 420° F. and an end point from 450° to 490° F.

18. A process according to claim 16 in which the gasoline product has an octane numer of at least 87 (R+0) and the second distillate fraction of increased paraffinic content has a cetane number of at least 30.

* * * * *